United States Patent [19]

Koff

[11] Patent Number: 4,769,671

[45] Date of Patent: Sep. 6, 1988

[54] APPARATUS FOR POSITIONING A PHOTOCONDUCTIVE BELT FOR DEVELOPMENT

[75] Inventor: Jeffrey M. Koff, Fairport, N.Y.

[73] Assignee: Xerox Corporation, Stamford, Conn.

[21] Appl. No.: 87,279

[22] Filed: Aug. 20, 1987

[51] Int. Cl.[4] ..... G03G 15/06

[52] U.S. Cl. ..... 355/3 BE; 355/3 DD; 355/14 D; 355/16; 271/273; 474/112

[58] Field of Search ..... 355/3 BE, 3 DD, 14 D, 355/16, 4; 118/645; 198/814, 639; 271/118, 273; 474/101, 113, 119, 136, 112

[56] References Cited

U.S. PATENT DOCUMENTS

| | | | |
|---|---|---|---|
| 2,823,937 | 9/1955 | Barre | 474/113 |
| 4,025,068 | 5/1977 | Collins | 271/124 X |
| 4,114,536 | 9/1978 | Kaneko et al. | 355/3 BE X |
| 4,144,808 | 3/1979 | Iwasa et al. | 101/1 |
| 4,183,658 | 1/1980 | Winthaegen | 355/3 BE |
| 4,279,496 | 7/1981 | Silverberg | 355/3 BE |
| 4,457,269 | 7/1984 | Beardmore | 474/101 X |
| 4,537,494 | 8/1985 | Lubinsky et al. | 355/16 X |
| 4,630,919 | 12/1986 | Fantuzzo et al. | 355/4 |

FOREIGN PATENT DOCUMENTS

| | | | |
|---|---|---|---|
| 57-208343 | 12/1982 | Japan | 474/101 |
| 60-88257 | 5/1985 | Japan | 474/101 |
| 61-192626 | 8/1986 | Japan | 271/118 |

*Primary Examiner*—Arthur T. Grimley
*Assistant Examiner*—Jane K. Lau
*Attorney, Agent, or Firm*—H. Fleischer; J. E. Beck; R. Zibelli

[57] ABSTRACT

An apparatus in which a tubular member mounted on a shaft moves linearly in response to rotation of the shaft. A cam is mounted on the shaft and in engagement with bearings mounted on the interior surface of the tubular member. As the shaft rotates, the cam moves in unison therewith to move the tubular member linearly. The linear movement of the tubular member moves a portion of a photoconductive belt between an operative position, adjacent a developer unit, and an inoperative position, spaced from the developer unit.

6 Claims, 3 Drawing Sheets

APPARATUS FOR POSITIONING A PHOTOCONDUCTIVE BELT FOR DEVELOPMENT

This invention relates generally to an electrophotographic printing machine, and more particularly concerns an apparatus for moving a photoconductive belt between an inoperative position spaced from a developer unit and an operative position adjacent the developer unit.

In an electrophotographic printing machine, a photoconductive member is charged to a substantially uniform potential to sensitize the surface thereof. The charged portion of the photoconductive member is exposed to a light image of an original document being reproduced. Exposure of the charged photoconductive member selectively dissipates the charge thereon in the irradiated areas. This records an electrostatic latent image on the photoconductive member corresponding to the informational areas contained within the original document being reproduced. After the electrostatic latent image is recorded on the photoconductive member the latent image is developed by bringing marking particles into contact therewith. This forms a powder image on the photoconductive member which is subsequently transferred to a copy sheet. The copy sheet is heated to permanently affix the marking particles thereto in image configuration.

Various types of development systems have hereinbefore been employed. These systems utilize two component developer mixes or single component developer materials. Typical two component developer mixes employed are well known in the art, and generally comprise dyed or colored thermoplastic powders, known in the art as toner particles, which are mixed with coarser carrier granules, such as ferromagnetic granules. The toner particles and carrier granules are selected such that the toner particles acquire the appropriate charge relative the electrostatic latent image recorded on the photoconductive surface. When the developer mix is brought into contact with the charged photoconductive surface the greater attractive force of the electrostatic latent image recorded thereon causes the toner particles to transfer from the carrier granules and adhere to the electrostatic latent image.

Heretofore, development systems have employed rotary impellers, fur brushes, bucket conveyors and magnetic brush systems to achieve the requisite uniformity in toner deposition. Magnetic brush systems achieve a high degree of uniform deposition and, therefore, numerous electrophotographic printing machines utilize this type of development system. Usually, a magnetic brush system includes a developer roller having a directional flux field to bring the magnetizable developer mix into contact with the charged photoconductive surface. In an electrophotographic printing machine adapted to produce highlight colors, a portion of the copy is reproduced in a color other than the remainder of the copy. For example, in a document containing text, selected portions of the text may be reproduced in red while the remainder of the text is reproduced in black. The copy will have selected portions highlighted in red. This may be achieved by employing two development systems. One development system uses black toner particles with the other development system using red toner particles, or toner particles of any other selected color. Generally, the printing process is a two cycle process. During one cycle, the black portions of the copy are reproduced on the copy sheet and during the other cycle, the red portions of the copy are reproduced to form a copy having both red and black regions thereon. One difficultly with a system of this type is that the developer units must be isolated from one another to prevent co-mingling of the different color toner particles during development of the latent images. Hereinbefore, this has been achieved by mounting the developer units movably in the printing machine. In this way, one of the developer units is positioned in the operative position adjacent the photoconductive member with the other developer unit being in the inoperative position spaced from the photoconductive member. The developer units alternately move between the operative and inoperative positions, depending upon which developer unit is developing the latent image. This insures that each latent image will be developed with toner particles of the appropriate color without co-mingling of the toner particles. This technique, i.e. moving the developer units, is expensive and complex. A simpler and less costly approach is to move the photoconductive member between an inoperative position spaced from the developer unit and an operative position adjacent the developer unit. Various techniques have been devised for moving the photoconductive member. The following disclosures appear to be relevant:

- U.S. Pat. No. 4,144,808, Patentee: Iwasa et al., Issued: Mar. 20, 1979
- U.S. Pat. No. 4,183,658, Patentee: Winthaegen, Issued: Jan. 15, 1980
- U.S. Pat. No. 4,279,496, Patentee: Silverberg, Issued: July 21, 1981
- U.S. Pat. No. 4,630,919, Patentee: Fantuzzo et al., Issued: Dec. 23, 1986

The relevant portions of the foregoing disclosures may be briefly summarized as follows:

Iwasa et al. discloses a moving means for moving a pair of spaced rollers up and down. The rollers, in turn, move a transfer belt having a powder image thereon into and out of contact with a steel plate. The powder image is transferred from the belt to the plate.

Winthaegen describes a copier which employs an intermediate transfer support member for receiving images formed on a photoconductive belt. A pressure roller, which is part of a floating roller system, is used to change the path of the photoconductive belt, as required, for image transfer.

Silverberg discloses a photoconductive belt support system employing mounting members which are pivoted against the photoconductive belt at the developer station and cleaning station by inflating the corresponding bellows. In order to remove the belt, the bellows are deflated and springs pivot the respective mounting members away from the photoconductive belt facilitating the removal thereof from the fixed supports.

Fantuzzo et al. describes a system for selecting either of two different color developer units. Articulating backup blades alternately urge a photoconductive belt into engagement with one of the developer units.

Pursuant to the features of the present invention, there is provided an apparatus for moving at least a portion of a belt between an inoperative position, spaced from a processing station, and an operative position, adjacent the processing station. The apparatus includes a tubular member in contact with the belt. A shaft is disposed interiorly of the tubular member. Means, mounted on the shaft, is provided for moving the tubular member linearly. The tubular member, in turn, moves the belt between the operative position and the inoperative position.

In accordance with another aspect of the present invention, there is provided an electrophotograhic printing machine of the type in which a photoconductive member having an electrostatic latent image recorded thereon moves between an inoperative position, spaced from a developer unit, and an operative position, adjacent the developer unit. The printing machine includes a tubular member in contact with the photoconductive belt. A shaft is disposed interiorly of the tubular member. Means, mounted on the shaft, is provided for moving the tubular member linearly. The tubular member, in turn, moves the photoconductive belt between the operative position and the inoperative position.

Other aspects of the present invention will become apparent as the following description proceeds and upon reference to the drawings, in which.

While the present invention will hereinafter be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 1:
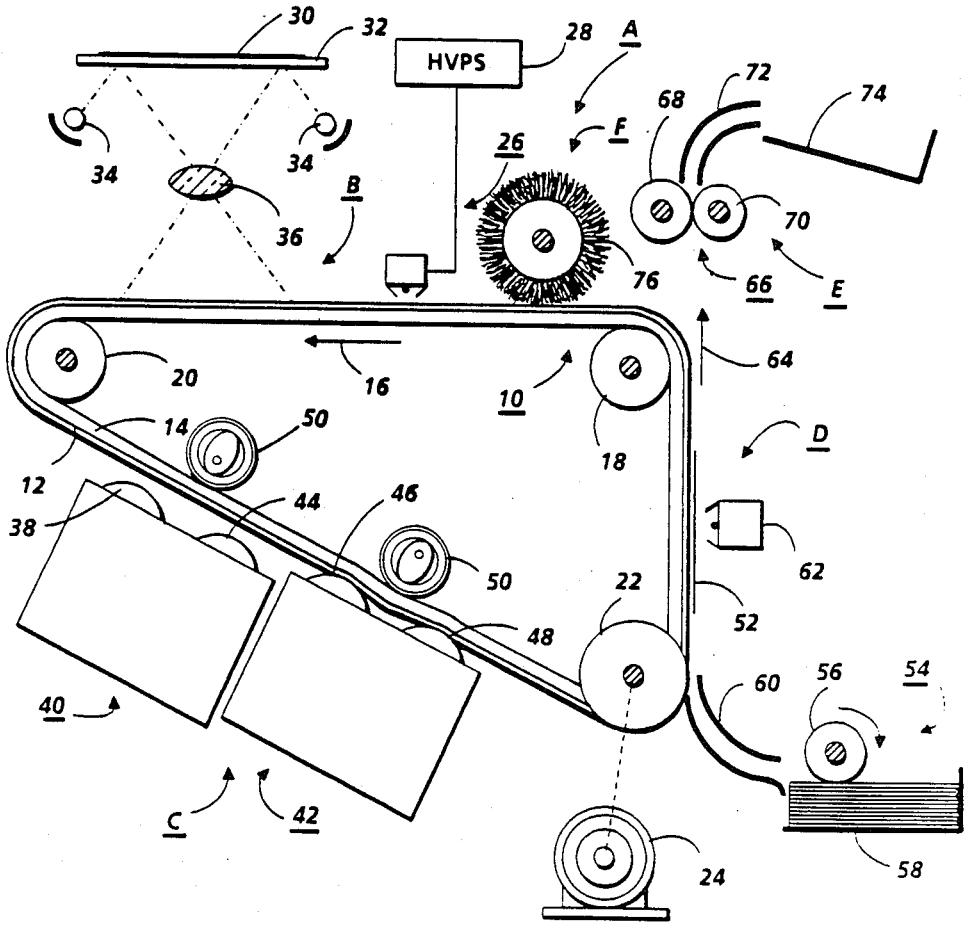
FIG. 1 is a schematic elevational view depicting an electrophotographic printing machine incorporating the features of the present invention therein.

For a general understanding of the features of the present invention, reference is made to the drawings. In the drawings, like references have been used throughout to designate identical elements. FIG. 1 schematically depicts the various components of an illustrative electrophotographic printing machine incorporating the apparatus of the present invention therein. It will become evident from the following discussion that the apparatus of the present invention is equally well suited for use in a wide variety of electrostatographic printing machines, and is not necessarily limited in its application to the particular electrophotographic printing machine shown herein.

Inasmuch as the art of electrophotographic printing is well known, the various processing stations employed in the FIG. 1 printing machine will be shown hereinafter schematically and their operation described briefly with reference thereto.

Referring now to FIG. 1, the electrophotographic printing machine employs a belt 10 having a photoconductive surface deposited on a conductive substrate 14. Preferably, photoconductive surface 12 is made from a selenium alloy. Conductive substrate 14 is made preferably from an aluminum alloy which is electrically grounded. Belt 10 moves in the direction of arrow 16 to advance successive portions of photoconductive surface 12 sequentially through the various processing stations disposed about the path of movement thereof. Belt 10 is entrained about stripping roller 18, tensing roller 20 and drive roller 22. Drive roller 22 is mounted rotatably in engagement with belt 20. Motor 24 rotates roller 22 to advance belt 10 in the direction of arrow 16. Roller 22 is coupled to motor 24 by suitable means, such as a drive belt. Belt 10 is maintained in tension by a pair of springs (not shown) resiliently urging tensioning roller 20 against belt 10 with the desired spring force. Stripping roller 18 and tensioning roller 20 are mounted to rotate freely.

Initially, a portion of belt 10 passes through charging station A. At charging station A, a corona generating device, indicated generally by the reference numeral 26 charges photoconductive surface 12 to a relatively high, substantially uniform potential. High voltage power supply 28 is coupled to corona generating device 26. Excitation of power supply 28 causes corona generating device 26 to charge photoconductive surface 12 of belt 10. After photoconductive surface 12 of belt 10 is charged, the charged portion thereof is advanced through exposure station B.

At exposure station B, an original document 30 is placed face down upon a transparent platen 32. Lamps 34 flash light rays onto original document 30. The light rays reflected from original document 30 are transmitted through lens 36 to form a light image thereof. Lens 36 focuses this light image onto the charged portion of photoconductive surface 12 to selectively dissipate the charge thereon. This records an electrostatic latent image on photoconductive surface 12 which corresponds to the informational areas contained within original document 30.

After the electrostatic latent image has been recorded on photoconductive surface 12, belt 10 advances the latent image to development station C. At development station C, magnetic brush developer units, indicated generally by the reference numerals 40 and 42, are selectively operatable to advance developer material of different colors into contact with the latent image. Developer rollers 38 and 44 of developer unit 40 and developer rollers 46 and 48 of developer unit 42 are adapted to advance developer material into contact with the latent image. These developer rollers form a brush of carrier granules and toner particles extending outwardly therefrom. The latent image attracts the toner particles from the carrier granules forming a toner powder image thereon. In order to produce highlight color copies, belt 10 is positioned in the operative position with respect to one developer unit and in the inoperative position with respect to the other developer unit during each latent image development cycle. By way of example, belt 10 is shown in the inoperative position with respect to developer unit 40. As is shown, rollers 38 and 44 are spaced a sufficient distance from photoconductive surface 12 so as to prevent development of the latent image recorded thereon. Belt 10 is in the operative position with respect to developer unit 42. In the operative position, belt 10 is entrained about a portion of rollers 46 and 48. Rollers 50, disposed interiorly of belt 10 opposed from developer units 40 and 42, move belt 10 between the operative and inoperative positions. When one roller 50 moves the portion of photoconductive belt 10 opposed from developer unit 42 to the operative position, belt 10 is wrapped about a portion of developer rollers 46 and 48. This forms an extended development zone. Simultaneously, the other roller 50 moves the portion of belt 10 opposed from developer unit 40 to the inoperative position spaced from developer rollers 38 and 44. Of course rollers 50 move the respective portions of the belt to the operative and inoperative positions when developer unit 40 is operational and developer unit 42 is not operational. By way of example, developer unit 40 develops the latent image with toner particles of one color, e.g. black toner particles, whereas developer unit 42 develops the latent image with highlight color toner particles, e.g. red toner particles. In this way, a color highlight copy may be created. This achieved by masking a selected portion of the original document desired to be reproduced in red. Thus, all of the portions of the original document desired to be reproduced in black are illuminated during the first cycle. Rollers 50 move the portion of belt 10 opposed from developer unit 40 to the operative position, i.e. adjacent thereto, and the portion of belt 10 opposed from developer unit 42 to the inoperative position, i.e. spaced therefrom. This latent image is developed with the black toner particles. Thereafter, the original document is remasked with the areas previously reproduced in black covered and those previously masked uncovered. At this time, rollers 50 move the portion of belt 10 opposed from developer unit 40 to the inoperative position and the portion of belt 10 opposed from developer unit 42 to the operative position. Thus, the second latent image is now developed with red toner particles. The black toner particles developed on the first latent image and red toner particles developed on the second latent image are transferred to a common copy sheet forming a copy color highlighted in red. Alternatively, the areas desired to be reproduced in red can be designated on an edit pad. The edit pad transmits the coordinates of the red regions. During the first cycles, the designated red regions of the latent image are erased and only the black regions remain on the latent image. This latent image is developed with black toner particles. During the next cycle, the black regions are erased and only the red regions of the latent image remain recorded on the photoconductive surface. This latent image is now developed with red toner particles. The details of roller 50 will be described hereinafter with reference to FIGS. 2 and 3.

With continued reference to FIG. 1, after the electrostatic latent image is developed, belt 10 advances the toner powder image to transfer station D. A sheet of support material 52 is advanced to transfer station D by sheet feeding apparatus 54. Preferably, sheet feeding apparatus 54 includes a feed roll 56 contacting the uppermost sheet of stack 58. Feed roller 56 rotates to advance the uppermost sheet from stack 58 into chute 60. Chute 60 directs the advancing sheet of support material into contact with photoconductive surface 12 of belt 10 in a timed sequence so that the toner powder image contacts the advancing sheet of support material at transfer station D. Transfer station D includes a corona generating device 62 which sprays ions onto the backside of sheet 52. This attracts the toner powder image from photoconductive surface 12 to sheet 52. After transfer, sheet 52 continues to move in the direction of arrow 64 onto a conveyor (not shown) which advances sheet 52 to fusing station E.

Fusing station E includes a fuser assembly, indicated generally by the reference numeral 66, which permanently affixes the transferred powder image to sheet 52. Preferably, fuser assembly 66 comprises a heated fuser roller 68 and a back-up roller 70. Sheet 52 passes between fuser roller 67 and back-up roller 70 with the toner powder image contacting fuser roller 68. In this way, the toner powder image is permanently affixed to sheet 52. After fusing, chute 72 advances sheet 52 to catch tray 74 for subsequent removal from the printing machine by the operator. If a color highlighted copy is being reproduced, the copy sheet returns to the transfer station in a timed sequence with the next developed latent image to have the color highlighted toner particles transferred thereto. This may be achieved by manually returning the copy sheet, after fusing of the first color toner particles thereto, to stack 58 or by a conveyor system which returns the copy sheet to the transfer station before of after fusing of the first color toner particles thereto. In either case, the copy sheet must be returned to the transfer station in registration with the electrostatic latent image.

After the sheet of support material is separated from photoconductive surface 12 of belt 10, the residual toner particles adhering to photoconductive surface 12 are removed therefrom at cleaning station F. Cleaning station F includes a rotatably mounted fibrous brush 76 in contact with photoconductive surface 12. The particles are cleaned from photoconductive surface 12 by rotation of brush 76 in contact therewith. Subsequent to cleaning, a discharge lamp (not shown) floods photoconductive surface 12 with light to dissipate any residual electrostatic charge remaining thereon prior to the charging thereof for the next successive imaging cycle.

It is believed that the foregoing description is sufficient for purposes of the present invention to illustrate the general operation of an electrophotographic printing machine incorporating the features of the present invention therein.

Figure 2:
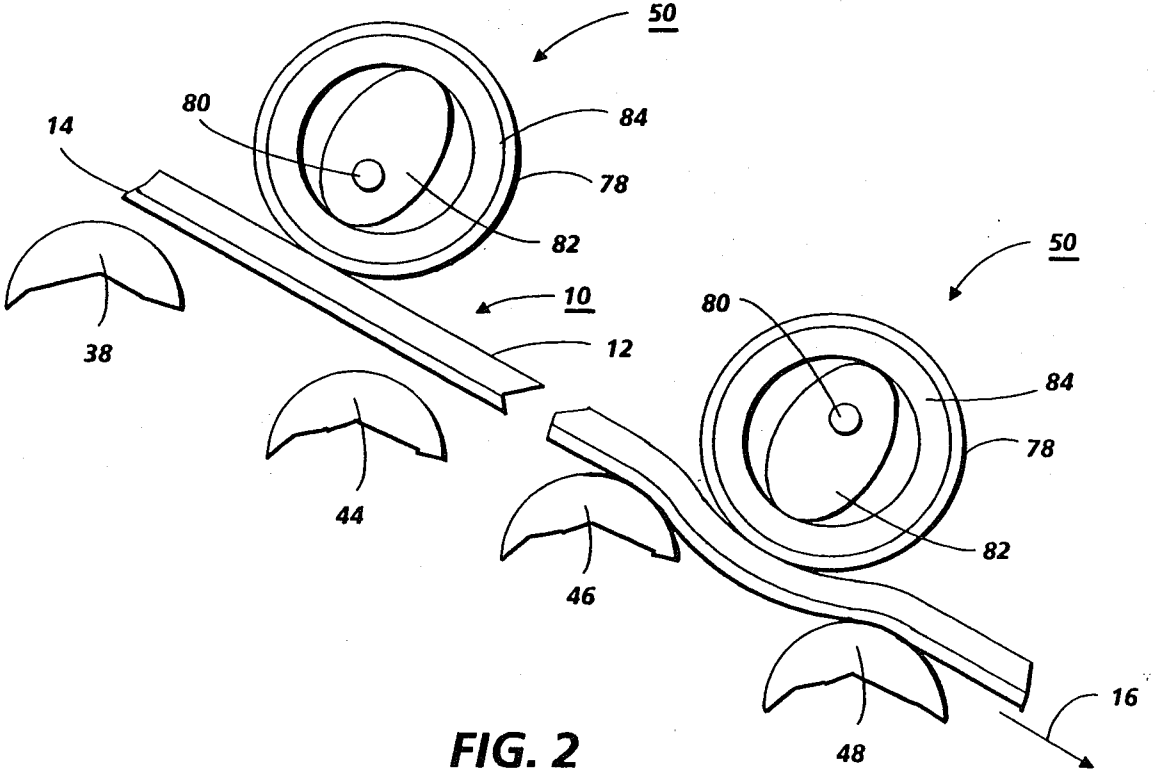
FIG. 2 is a schematic elevational view showing the photoconductive belt used in the FIG. 1 printing machine moved adjacent one developer unit and spaced from the other developer unit by rollers of the present invention.

Referring now to FIG. 2, there is shown the manner in which rollers 50 move belt 10 between the operative and inoperative positions. Rollers 50 have a tubular member 78 adapted to engage belt 10. A shaft 80 is mounted on the developer unit housing and indexed rotatably by a motor, or any other suitable rotary actuator. A pair of cams 82 are mounted fixedly on opposed ends of shaft 80. The inner races of bearings 84 are mounted fixedly on cams 82. The outer races of bearings 84 are mounted fixedly on the interior circumferential surface of tubular member 78. In operation, rollers 50 move belt 10 between the operative position, wherein belt 10 is adjacent the rollers of the developer unit, and the inoperative position, wherein belt 10 is spaced from the developer unit. This is achieved by rotating shaft 80. As shaft 80 rotates, cams 82 rotate in unison therewith. As cams 82 rotate, the inner race of bearing 84 rotates in unison therewith. Cams 82 rotate about 180° to move belt 10 between the inoperative position and the operative position. As shown in FIG. 2, roller 50, opposed from developer unit 40, has positioned belt 10 in the inoperative position. When shaft 80 is rotated 180° with respect to tubular member 78, tubular member 78 moves linearly to move belt 10 closely adjacent to the developer unit. Roller 50, opposed from developer unit 42, is shown after shaft 80 has rotated 180°. As shown, cam 82 has moved tubular member 78 linearly to move belt 10 from the inoperative position to the operative position. In addition to being movable linearly, tubular member 78 rotates. This insures that as belt 10 moves in the direction of arrow 16, there is rolling contact between belt 10 and tubular member 78 rather than sliding contact. Sliding contact abrades the belt degradating life and performance.

Figure 3:
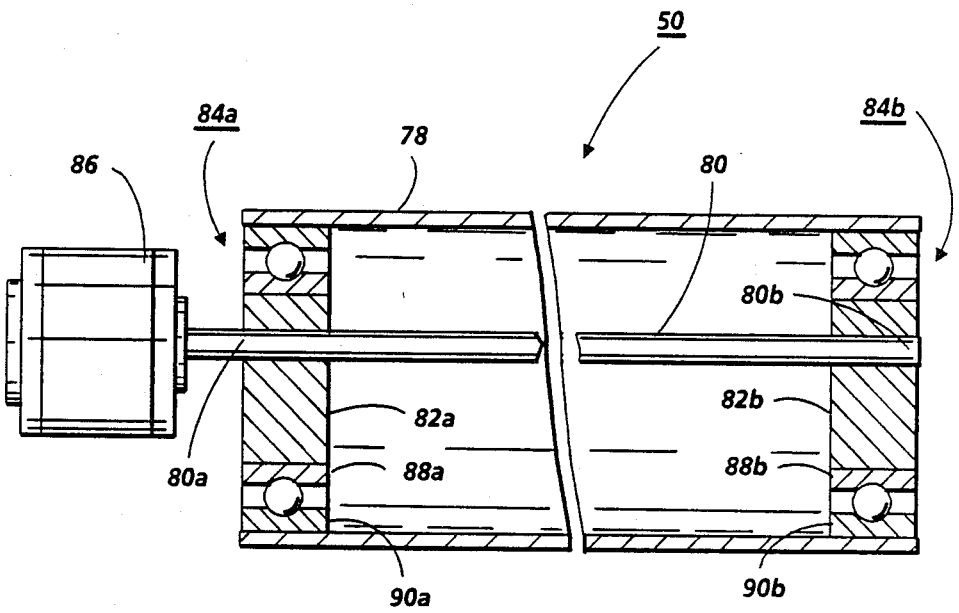
FIG. 3 is an elevational view illustrating one of the FIG. 2 rollers.

Turning now to FIG. 3, motor 86, in response to a control signal from the microprocessor of the printing machine, rotates shaft 80 180° to move belt 10 between the inoperative and operative positions. Cam **82*a* is mounted, e.g. press fit, on end 80*a* of shaft 80. Cam 82*b*** is mounted, e.g. press fit, on end 80*b* of shaft 80. The inner race 88*a* of bearing 84*a* is mounted, e.g. press fit, on cam 82*a*. The outer race 90*a* of bearing 84*a* is mounted, e.g. press fit, on the interior circumferential surface of tubular member 78. Inner race 88*b* of bearing 84*b* is mounted, e.g. press fit, on cam 82*b*. Outer race 90*b* of bearing 84*b* is mounted, e.g. press fit, on the interior circumferential surface of tubular member 78. Cam 82*a* and cam 82*b* rotate in unison with shaft 80. Inner races 88*a* and 88*b* of bearings 84*a* and 84*b*, respectively, rotate in unison with cams 82*a* and cams 82*b*, respectively. Outer races 90*a* and 90*b* of bearings 84*a* and 84*b*, respectively, rotate in unison with tubular member 78. Thus, the frictional force between belt 10 and tubular member 78 rotates tubular member 78 relative to shaft 10. Rotation of shaft 80 rotates cams 82*a* and 82*b* causing tubular member 70 to move linearly so as to move belt 10 between the operative and inoperative positions.

In recapitulation, it is clear that the rollers of the present invention include a tubular member which contacts the photoconductive belt and is rotated by the frictional force therebetween. A shaft having a cam mounted thereon is disposed interiorly of the tubular member. The tubular member is mounted on bearings which, in turn, are also mounted on the cams. In this way, rotation of the shaft rotates the cams, which, in turn, move the tubular member linearly. Linear movement of the tubular member moves the photoconductive belt between the inoperative position and the operative position relative to the developer units in the printing machine. This enables selected developer units to be operational without coupling therebetween.

It is, therefore, apparent that there has been provided in accordance with the present invention, an apparatus for moving at least a portion of the photoconductive belt between an inoperative position spaced from a developer unit and an operative position adjacent the developer unit that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations as fall within the spirit and broad scope of the appended claims.

I claim:

1. An apparatus for moving at least a portion of a belt between an inoperative position, spaced from a processing station, and an operative position, adjacent the processing unit, including:

a tubular member in contact with the belt;

a shaft disposed interiorly of said tubular member; and means, mounted on said shaft interiorly of said tubular member, for moving said tubular member linearly to move the belt between the operative position and the inoperative position, said moving means rotating in unison with said shaft and supporting said tubular member rotatably so that said moving means moves said tubular member linearly in response to rotation of said shaft; and means for rotating said shaft through a preselected angle.

2. An apparatus according to claim 1, wherein said moving means includes:

a cam mounted on said shaft to rotate in unison therewith; and a bearing having the outer race thereof mounted on the interior circumferential surface of said tubular member with the inner race being mounted on said cam.

3. An apparatus according to claim 2, wherein said moving means includes:

a second cam mounted on one end of said shaft to rotate in unison therewith with said first mentioned cam being mounted on the other end of said shaft; and a second bearing having the inner race thereof mounted on said second cam with the outer race being mounted on the interior circumferential surface of said tubular member on the end thereof corresponding to the one end of said shaft having said second cam mounted thereon with said first mentioned bearing having the inner race thereof mounted on said first mentioned cam and the outer race mounted on the interior circumferential surface of said tubular member on the end thereof corresponding to the other end of said shaft.

4. An electrophotographic printing machine of the type in which a photoconductive belt having an electrostatic latent image recorded thereon moves between an inoperative position, spaced from a developer unit, and an operative position, adjacent the developer unit, including:

a tubular member in contact with the photoconductive belt;

a shaft disposed interiorly of said tubular member; and means, mounted on said shaft interiorly of said tubular member, for moving said tubular member linearly so as to move the photoconductive belt between the operative position and the inoperative position, said moving means rotating in unison with said shaft and supporting said tubular member rotatably so that said moving means moves said tubular member linearly in response to rotation of said shaft; and means for rotating said shaft through a preselected angle.

5. A printing machine according to claim 4, wherein said moving means includes:

a cam mounted on said shaft to rotate in unison therewith; and a bearing having the outer race thereof mounted on the interior circumferential surface of said tubular member with the inner race being mounted on said cam.

6. A printing machine according to claim 5, wherein said moving means includes:

a second cam mounted on one end of said shaft to rotate in unison therewith with said first mentioned cam being mounted on the other end of said shaft; and a second bearing having the inner race thereof mounted on said second cam with the outer race being mounted on the interior circumferential surface of said tubular member on the end thereof corresponding to the one end of said shaft having said second cam mounted thereon with said first mentioned bearing having the inner race thereof mounted on said first mentioned cam and the outer race mounted on the interior circumferential surface of said tubular member on the end thereof corresponding to the other end of said shaft.

* * * * *